US012364907B2

(12) United States Patent
Griffin et al.

(10) Patent No.: US 12,364,907 B2
(45) Date of Patent: Jul. 22, 2025

(54) GOLF CLUB HEAD HAVING A COMPOSITE FACE

(71) Applicant: Wilson Sporting Goods Co., Chicago, IL (US)

(72) Inventors: Sean P. Griffin, Chicago, IL (US); Robert T. Thurman, Glen Ellyn, IL (US); Sean S. Epling, Portland, OR (US); Ty B. Goodwin, Vancouver, WA (US); Donald G. Loeffler, Portland, OR (US); James M. Earley, Roseville, CA (US); Jon C. Pergande, Chicago, IL (US); Jeremy H. Yim, Rocklin, CA (US); Richard P. Hulock, North Aurora, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 17/547,754

(22) Filed: Dec. 10, 2021

(65) Prior Publication Data

US 2023/0181976 A1 Jun. 15, 2023

(51) Int. Cl.
*A63B 53/04* (2015.01)

(52) U.S. Cl.
CPC ..... *A63B 53/0425* (2020.08); *A63B 53/0429* (2020.08); *A63B 53/0466* (2013.01); *A63B 53/047* (2013.01); *A63B 2209/02* (2013.01)

(58) Field of Classification Search
CPC ..... A63B 53/0425; A63B 53/0429; A63B 53/0466; A63B 53/047; A63B 2209/02
See application file for complete search history.

(56) References Cited

U.S. PATENT DOCUMENTS 4,204,684 A * 5/1980 Molitor ..... A63B 53/04 473/349
4,664,383 A * 5/1987 Aizawa ..... A63B 60/00 273/DIG. 7

(Continued)

OTHER PUBLICATIONS

Advanced Mechanics of Composite Materials, by Valery V. Vasiliev , https://reader.elsevier.com/reader/sd/pii/B9781455731268000087?token=066F417C243EA0A146B950DC742EFAFC48ACC3BC71C2F1266F41F74D66EA43F873A4ED81904643D0AA4FCF67 , 2013.*

(Continued)

*Primary Examiner* — William M Pierce
(74) *Attorney, Agent, or Firm* — Terence P. O'Brien; Todd A. Rathe

(57) ABSTRACT

A golf club includes a face coupled to a body. A composite axis extends from a heel to a toe of the club and parallel to ground. The face is formed of a fiber composite material including at least first and second sets of ply arrangements. Each of the ply arrangements includes a pair of plies having first and second pluralities of fibers defining first and second angles with respect to the composite axis, respectively. The face has a ball contact surface, an rear surface, and a mid-zone positioned equidistant between the contact and rear surfaces. A majority of the first and second pluralities of fibers of the ply arrangements between the mid-zone and the contact surface are formed of glass fibers, and a majority of the first and second pluralities of ply arrangements between the mid-zone and the rear surface are formed of carbon fibers.

18 Claims, 11 Drawing Sheets

(56) References Cited

U.S. PATENT DOCUMENTS 4,798,383 A * 1/1989 Nagasaki ..... A63B 60/00 473/348
5,193,811 A 3/1993 Okumoto et al.
5,312,106 A 3/1994 Cook
5,310,185 A * 5/1994 Viollaz ..... A63B 60/00 273/DIG. 23
5,377,986 A * 1/1995 Viollaz ..... A63B 53/0466 473/330
5,425,538 A * 6/1995 Vincent ..... A63B 53/0466 473/347
5,447,311 A * 9/1995 Viollaz ..... A63B 53/04 473/347
6,435,980 B1 8/2002 Reyes et al.
6,582,323 B2 6/2003 Soracco et al.
6,743,117 B2 * 6/2004 Gilbert ..... A63B 53/047 473/332
6,945,876 B2 9/2005 Nakahara et al.
7,108,612 B2 9/2006 Nakahara et al.
7,163,470 B2 1/2007 Galloway et al.
7,204,768 B2 4/2007 Nakahara et al.
7,258,631 B2 8/2007 Galloway et al.
7,267,620 B2 * 9/2007 Chao ..... A63B 53/0466 473/348
7,314,418 B2 1/2008 Galloway et al.
7,416,496 B2 8/2008 Galloway et al.
7,503,854 B2 3/2009 Galloway et al.
7,556,567 B2 7/2009 Galloway
7,628,712 B2 12/2009 Chao et al.
7,674,190 B2 3/2010 Galloway et al.
7,811,181 B2 10/2010 Galloway et al.
7,850,546 B2 12/2010 Chao et al.
7,862,452 B2 1/2011 Chao et al.
7,871,340 B2 1/2011 Chao et al.
7,874,936 B2 * 1/2011 Chao ..... A63B 53/0466 473/347
7,874,938 B2 * 1/2011 Chao ..... B29C 70/342 473/348
7,938,742 B2 5/2011 Galloway et al.
RE42,544 E 7/2011 Chao et al.
7,985,146 B2 7/2011 Lin et al.
8,096,897 B2 1/2012 Beach et al.
8,163,119 B2 4/2012 Chao
8,221,261 B2 * 7/2012 Curtis ..... A63B 53/04 473/345
8,303,435 B2 11/2012 Chao
8,496,542 B2 7/2013 Curtis et al.
8,517,859 B2 8/2013 Golden et al.
8,628,431 B2 1/2014 Chao
8,684,864 B2 4/2014 Lin et al.
8,758,161 B2 6/2014 Golden et al.
8,777,776 B2 * 7/2014 Wahl ..... A63B 53/047 473/345
8,858,359 B2 10/2014 Willett et al.
8,876,629 B2 11/2014 Deshmukh et al.
9,033,818 B2 5/2015 Myrhum et al.
9,259,628 B2 2/2016 Willett et al.
9,283,447 B1 * 3/2016 DeMille ..... A63B 60/00
9,283,449 B1 3/2016 DeMille et al.
9,409,066 B2 8/2016 Lin et al.
9,623,295 B2 4/2017 Willett et al.
9,682,291 B2 6/2017 Chao
9,717,960 B2 * 8/2017 Deshmukh ..... A63B 60/00
9,950,224 B2 4/2018 Willett et al.
10,046,484 B2 8/2018 Greaney et al.
10,080,935 B2 9/2018 Boyd et al.
10,080,936 B2 9/2018 Sander
10,143,898 B2 12/2018 Cornelius et al.
10,220,268 B2 3/2019 Golden et al.
10,350,468 B2 7/2019 Hebreo et al.
10,576,335 B2 3/2020 Greaney et al.
10,722,765 B2 7/2020 Schweigert et al.
2007/0043630 A1 * 2/2007 Lyden ..... A43B 7/22 705/26.5
2007/0049403 A1 * 3/2007 Chen ..... A63B 60/00 473/347
2008/0146374 A1 * 6/2008 Beach ..... A63B 60/00 473/350
2008/0149267 A1 * 6/2008 Chao ..... B29C 70/342 156/285
2008/0300068 A1 * 12/2008 Chao ..... B29C 70/342 156/267
2009/0005191 A1 * 1/2009 Lin ..... A63B 53/0466 473/331
2010/0151960 A1 * 6/2010 Wahl ..... A63B 53/0466 473/347
2011/0275451 A1 11/2011 Chao et al.
2012/0135822 A1 * 5/2012 Deshmukh ..... A63B 60/00 473/342
2012/0199282 A1 8/2012 Chao
2013/0017904 A1 1/2013 Woolley et al.
2018/0236320 A1 8/2018 Willett et al.
2019/0224533 A1 7/2019 Spackman et al.
2022/0088450 A1 * 3/2022 Milleman ..... A63B 60/54
2022/0184471 A1 * 6/2022 Greaney ..... A63B 53/0445
2022/0379175 A1 * 12/2022 Martens ..... B29C 66/7212
2022/0379178 A1 * 12/2022 Parsons ..... A63B 60/02

OTHER PUBLICATIONS

Springer Link, Mechanical Behaviour of 3D Multi-layer Braided Composites: Experimental, Numerical and Theoretical Study, https://link.springer.com/article/10.1007/s10443-017-9600-1, 2017.*
Computational Materials Science, Hybrid carbon/glass fiber composites: Micromechanical analysis of structure-damage resistance relationships, by Leon Mishnaevsky Jr. and Gaoming Dai, May 2013.*
National Library of Medicine, Mechanical and Impact Damage Analysis on Carbon/Natrual Fibers Hybrid Composites: A Review, by Carlo Sntulli, https://www.ncbi.nlm.nih.gov/pmc/articles/PMC6385000/, Feb. 2019.*
Hybrid Carbon and Glass Fibre Composites, Science Direct, A.R. Bunsel and B. Harris, https://www.sciencedirect.com/science/article/abs/pii/0010436174901074#:~:text=Hybrid%20composite%20materials%2C%20consisting%20of,either%20unbonded%20or%20bonded%20together., Jun. 2003.*
Tech Topics, Scrims and Their Use I GFRC, chrome-extension://efaidnbmnnnibpcajpcglclefindmkaj/https://sumiglas.com/wp-content/uploads/Tech-Topics-Scrims-and-their-use-1-2.pdf, Sep. 2023.*
Impact response of hybrid carbon/glass fibre reinforced polymer composites designed for engineering applications, https:// www.sciencedirect.com/science/article/pii/S1359836817318309, Jan. 2018.*
Peel Ply, https://www.sciencedirect.com/topics/engineering/peel-ply#:~:text=Peel%20ply%20is%20an%20extra,future%20time%20prior%20to%20bonding., 2013.*
Science Direct, 9-Understanding and Predicting Stiffness in Advanced Fiber-Reinforced Polymer (FRP) Composites for Structural Applications, Rui Miranda Guedes et al., Dec. 2013.*
Common Lay-up Terms and Condtions, https://www.usna.edu/Users/mecheng/pjoyce/composites/Short_Course_2003/7_PAX_Short_Course_Laminate-Orientation-Code.pdf, found on Internet Archive Waybackmachine as early as Jul. 2016.*

* cited by examiner

GOLF CLUB HEAD HAVING A COMPOSITE FACE

FIELD OF THE INVENTION

The present invention relates generally to a golf club head having a face formed of a fiber composite material.

BACKGROUND OF THE INVENTION

Golf is a sport enjoyed by golfers of all ages and skill levels. Golfers often seek golf clubs that provide consistent exceptional performance. Golfers also seek golf clubs that provide a pleasing feel upon impacting a golf ball.

Accordingly, there is a continuing need for golf clubs that improve a golfer's performance and enjoyment of the game. There is also a continuing need for golf clubs that provide an exceptional feel when impacting a golf ball. Further, there is a need for a golf club that meets these needs while also providing an improved, pleasing aesthetic.

SUMMARY OF THE INVENTION

One example implementation of the present invention provides a golf club configured to be positioned in a golf ball address position. The golf club includes a body having a heel portion and a toe portion, and a face coupled to the body. A composite axis extends from the heel portion to the toe portion and is parallel to ground when the golf club is positioned in the golf ball address position. The face has a golf ball contact surface and an rear surface. The face is formed of a fiber composite material including at least first and second sets of ply arrangements. Each of the ply arrangements include a pair of plies with one ply having a first plurality of fibers defining a first angle with respect to the composite axis and the other ply having a second plurality of fibers defining a second angle with respect to the composite axis. The pair of plies include at least one resin. The first and second pluralities of fibers of the first set of ply arrangements are glass fibers and the first and second pluralities of fibers of the second set of ply arrangements are carbon fibers. The first set of ply arrangements is positioned closer to the golf ball contact surface than to the rear surface, and the second set of ply arrangements is positioned closer to the rear surface than to the golf ball contact surface. The ratio of the number of ply arrangements of the first set of ply arrangements to the number of ply arrangements of the second set of ply arrangements is at least 0.25.

According to another example implementation of the present invention, a golf club configured to be positioned in a golf ball address position. The golf club includes a body having a heel portion and a toe portion, and a face coupled to the body. A composite axis extends from the heel portion to the toe portion and is parallel to ground when the golf club is positioned in the golf ball address position. The face is formed of a fiber composite material. The fiber composite material includes at least first and second sets of ply arrangements. Each of the ply arrangements includes a pair of plies with one ply having a first plurality of fibers defining a first angle with respect to the composite axis and the other ply having a second plurality of fibers defining a second angle with respect to the composite axis. The face has a golf ball contact surface and an rear surface, and a mid-zone positioned equidistant between the golf ball contact surface and the rear surface. A majority of the first and second pluralities of fibers of the ply arrangements between the mid-zone and the golf ball contact surface are formed of glass fibers, and a majority of the first and second pluralities of fibers of the ply arrangements between the mid-zone and the rear surface are formed of carbon fibers.

This invention will become more fully understood from the following detailed description, taken in conjunction with the accompanying drawings described herein below, and wherein like reference numerals refer to like parts.

Figure 1A:
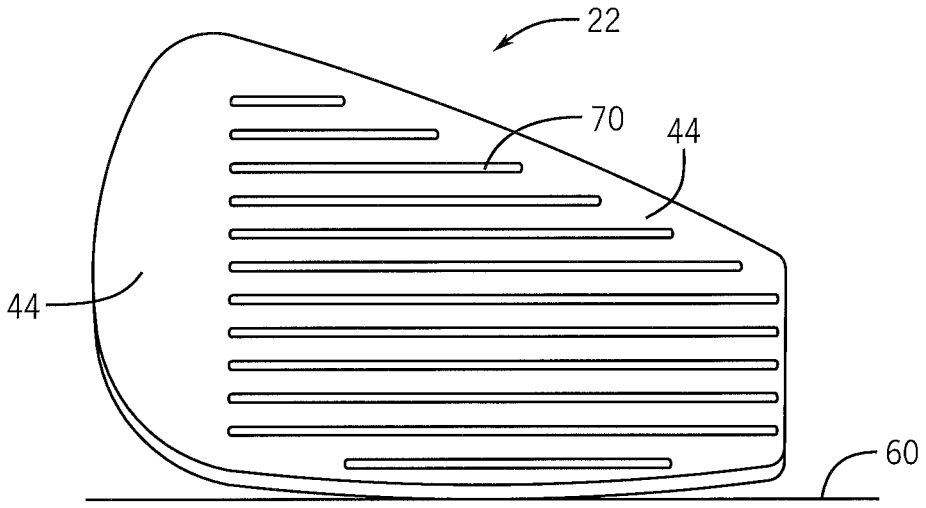
FIG. 1A is a front perspective view of a faceplate for an iron-type golf club in accordance with one example implementation.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF THE PREFERRED EMBODIMENTS

Figure 1B:
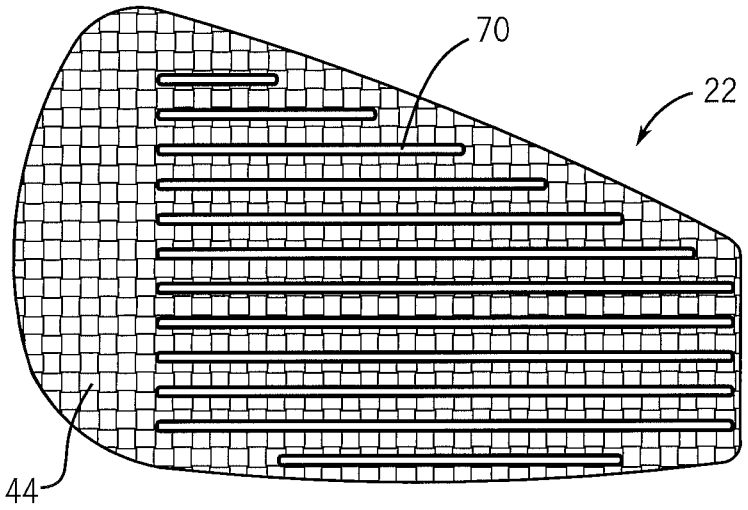
FIG. 1B is a front perspective view of a faceplate for an iron-type golf club in accordance with a second example implementation.

Referring to FIGS. 1 through 3B, an iron golf club is indicated generally at 10. The golf club 10 of FIG. 1 is configured as an iron. The present invention can also be formed as, and is directly applicable to, utility irons, drivers, fairway woods, hybrids, irons, wedges, putters and combinations thereof in sets of golf clubs. The golf club 10 is an elongate implement configured for striking a golf ball and includes a golf shaft 12 having a butt end with a grip and a tip end 14 coupled to a club head 16.

Figure 2:
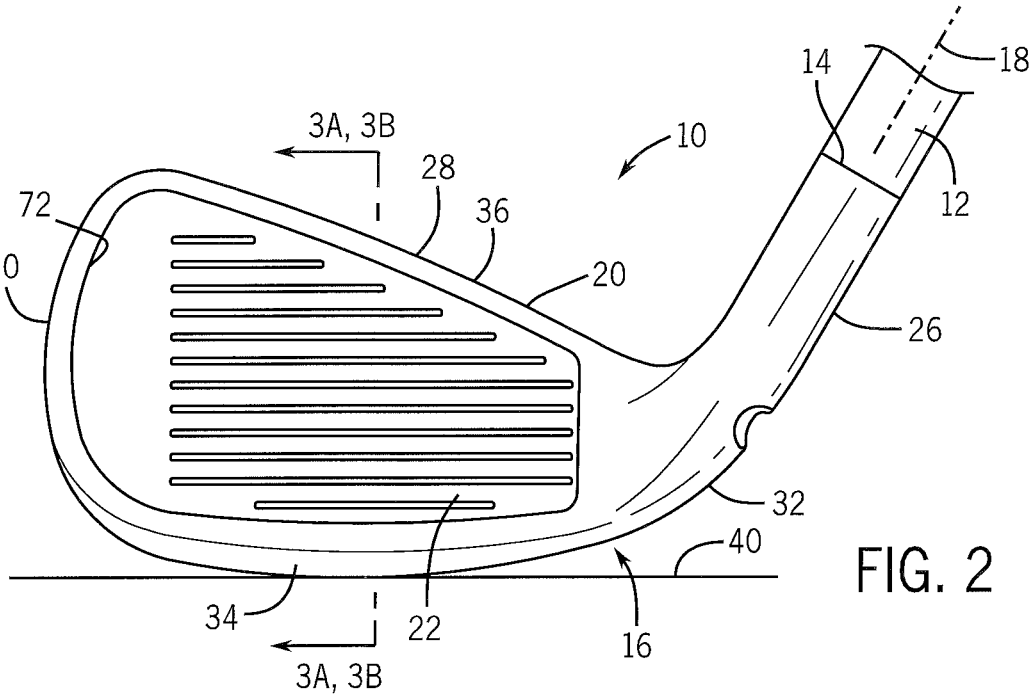
FIG. 2 is a front perspective of an iron-type golf club including the faceplate of FIG. 1B.

Referring to FIG. 2, the shaft 12 is an elongate hollow tube extending along a first longitudinal axis 18. The shaft 12 tapers toward the tip end 14. In one implementation, the tip end has an outside diameter of less than 0.400 inch. In other implementations, the outside diameter can be within the range of 0.335 to 0.370 inch. The shaft 12 is formed of a lightweight, strong, flexible material, preferably as a composite material. In alternative embodiments, the shaft 12 can be formed of other materials such as, other composite materials, steel, other alloys, wood, ceramic, thermoset polymers, thermoplastic polymers, and combinations thereof.

Figure 3A:
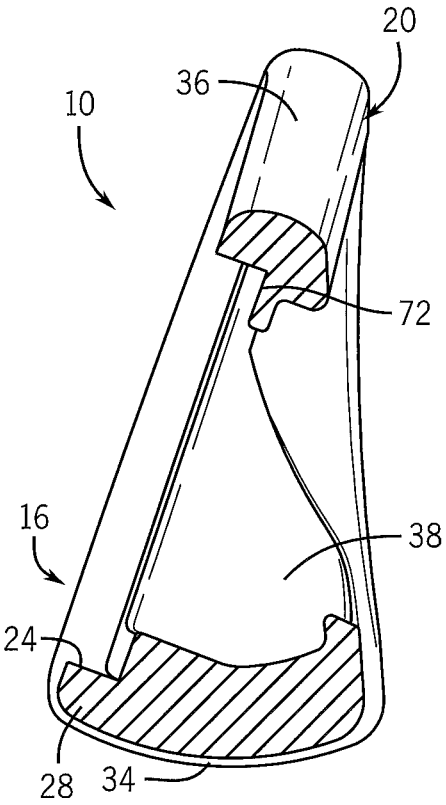
FIG. 3A is cross-sectional view of a body of a golf club head taken along line 3A-3A of FIG. 2 without the faceplate.
Figure 3B:
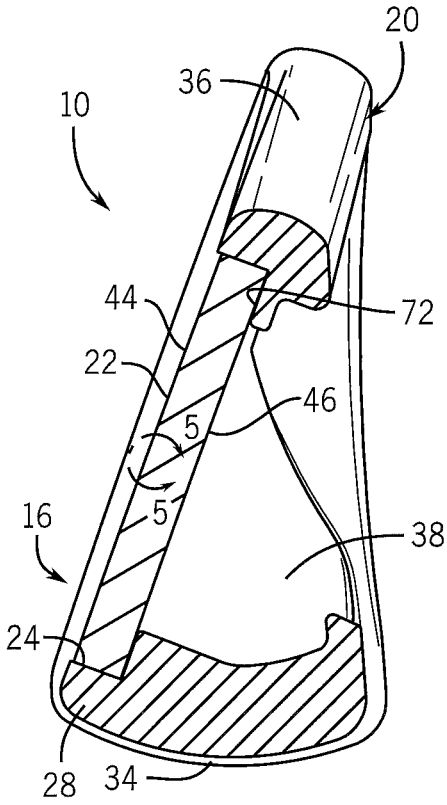
FIG. 3B is cross-sectional view of a body of a golf club head taken along line 3B-3B of FIG. 2.

Referring to FIGS. 2, 3A and 3B, the club head 16 includes a body 20 that is coupled to the shaft 12. For purposes of this disclosure, the term "coupled" shall mean the joining of two members directly or indirectly to one another. Such joining may be stationary in nature or movable in nature. Such joining may be achieved with the two members or the two members and one or more additional intermediate members being formed as a single unitary body with one another or with the two members or the two members and any additional intermediate member being attached to one another.

In one implementation, the club head 16 can be formed as a single unitary, integral body through a combination of casting and welding. In another implementation, the club head 10 can be formed through a combination of forging and welding. In other implementations, the components of the club head can be formed through casting, forging, welding, or a combination thereof. Club head 16 comprises a faceplate 22 that is coupled to body 20 across a front opening 24 defined by body 20. The body 20 includes a hosel 26, a faceplate supporting wall 28, a toe portion 30, a heel portion 32, a sole 34 and a topline 36. The hosel 26 connects to the shaft 12. The faceplate supporting wall 28, sole 34 and topline 36 define a rear cavity 38. The golf club 10 is shown on a ground plane 40 in a grounded address position.

The faceplate 22 is bonded to the faceplate supporting wall 28 with an epoxy adhesive. In other implementations, the faceplate 22 can be coupled to the face supporting wall 28 through other conventional fastening mechanisms, such as, for example, other adhesives, urethane adhesives, acrylic adhesives, methacrylate-based adhesives, molding and combinations thereof. The faceplate 22 has a golf ball contact surface 44, a rear surface 46 and a mid-plane 48 (for generally flat faceplates) or mid-zone for non-planar faceplates. The mid-plane 48 or mid-zone being defined by locations within the faceplate 22 that are equidistant from the golf ball contact surface 44 and the rear surface 46.

Figure 4A:
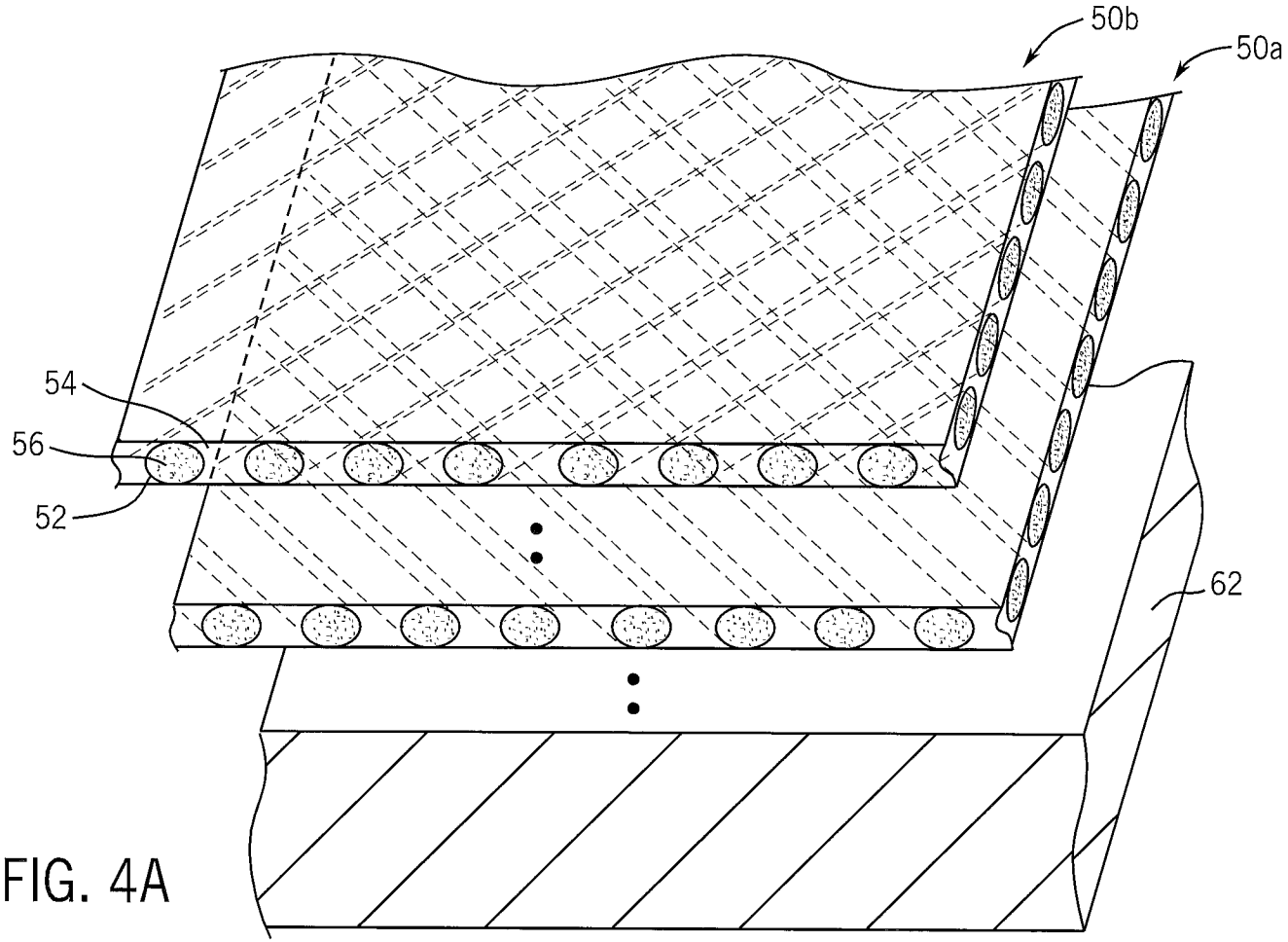
FIG. 4A is a top perspective view of a portion of two representative plies of a fiber composite material shown spaced apart from each other and from a forming structure.
Figure 4B:
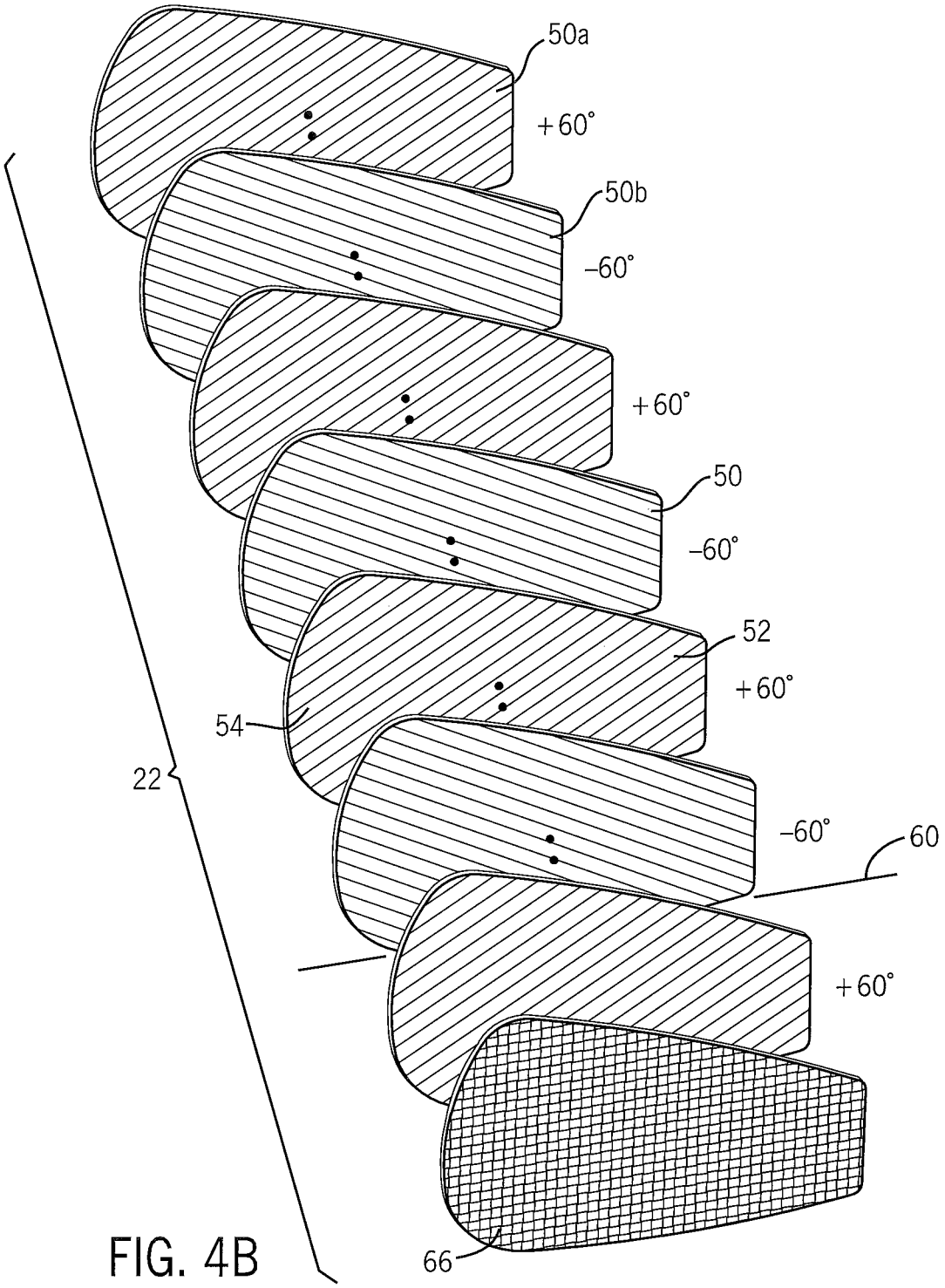
FIG. 4B is a front, side view of a plurality of plies shown in a spaced-apart manner prior to molding.
Figure 4C:
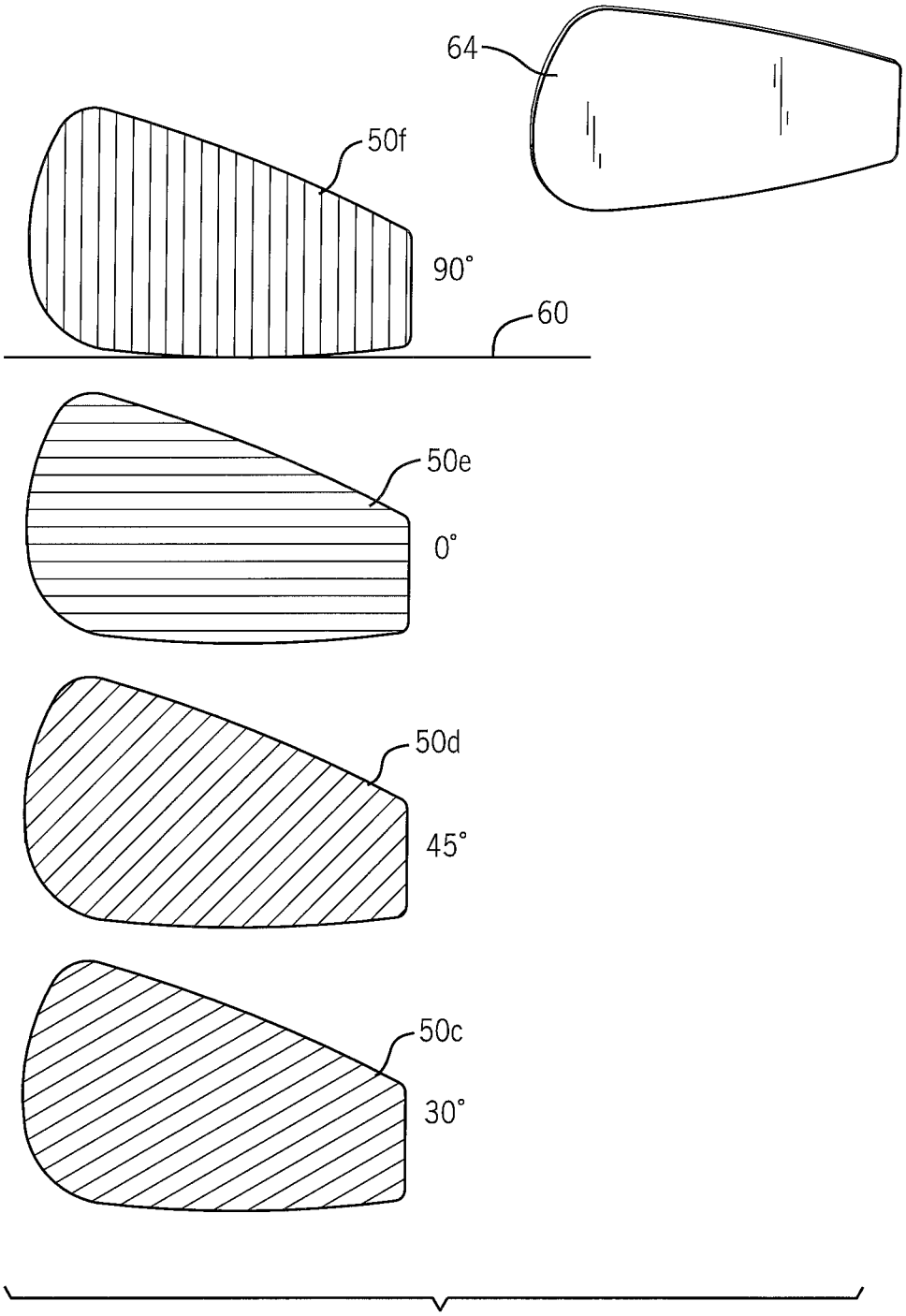
FIG. 4C is front views of a plurality of other example plies.

Referring to FIGS. 1A through 4C, the faceplate 22 is formed of a unique fiber composite material. As used herein, the terms "composite material" or "fiber composite material" refer to a matrix or a series of plies 50 (also referred to as sheets or layers) of fiber bundles 52 impregnated (or permeated throughout) with a resin 54. Referring to FIGS. 4A, 4B and 4C, the fiber bundles 52 can be co-axially bundled and aligned in the plies 50.

A single ply 50 typically includes hundreds or thousands of fiber bundles 52 that are initially arranged to extend coaxially and parallel with each other through the resin 54 that is initially uncured. Each of the fiber bundles 52 includes a plurality of fibers 56. The fibers 56 are formed of a high tensile strength materials such as carbon and glass. Alternatively, the fibers can be formed of other materials such as, for example, graphite, boron, basalt, para aramid, Kevlar®, Spectra®, carrot, poly-para-phenylene-2,6-benzobisoxazole (PBO), hemp and combinations thereof. In one set of preferred embodiments, the resin 54 is preferably a thermoset material, such as a highly toughened epoxy. In other implementations, the resin can be formed of a polyester or other epoxy materials. The resin 54 can be formed of the same material from one ply to another ply. Alternatively, each ply can use a different resin formulation. During heating and curing, the resin 54 can flow between plies 50 and within the fiber bundles 52. The plies 50 preferably typically have a thickness within the range of 0.002 to 0.015 inch. In a particularly preferred embodiment, the ply 50 can have a thickness within the range of 0.005 to 0.006 in. In other alternative preferred embodiments, other thickness ranges can also be used.

The plies 50 are originally formed in flexible sheets or layers in an uncured resin 54. In this configuration, the fibers 56 and the fiber bundles 52 are arranged and aligned such that the fibers 56 generally extend coaxially with respect to each other and are generally parallel to one another. As the ply 50 (for example, ply 50*a* of FIG. 4A) is positioned over or within a forming structure 62 (for example, a mold), the ply 50 is shaped to follow the form or follow the shape of the forming structure 62. One ply 50 is positioned over another ply 50 and so on (for example, plies 50*a* and 50*b* of FIG. 4A). Accordingly, the fiber bundles 52 and fibers 56 also follow the shape of the forming structure. In a formed position or state, the ply 50 may be a substantially flat sheet, or can be formed with some amount of curvature or contour. If the forming structure 62 has a generally flat surface, then the ply (or plies) 50 will also have a substantially flat shape. Similarly, if the forming structure has some curvature or contour to it, the plies will take a shape that follows the curved shape of the forming structure. In such examples, where the cured ply 50 is no longer in a flat sheet, the fiber bundles 52 and fibers 56 will no longer follow or define generally parallel lines. Rather, the fiber bundles 52 and fibers 56 are adjacent to one another, and are curved or otherwise formed so that they follow substantially the same adjacent paths. For example, if a ply 50 is wrapped about the convex shaped forming structure, the ply 50 can take a generally convex shape and the fiber bundles 52 and fibers 56 can follow the same convex shape (depending upon their angle within the ply 50). The fiber bundles 52 remain adjacent to one another, are aligned with each other and follow substantially similar paths that are essentially parallel (or even co-axial) for example, when viewed in a sectional view in a single plane or other small finite segment of the ply 50.

The fibers 56 or fiber bundles 52 are preferably formed such that they extend along the ply 50 and form generally the same angle with respect to an axis, such as a composite axis 60. The composite axis 60 extends in a direction from the heel portion 32 to the toe portion 30 of the body 20. In one implementation, the ground axis 60 may be parallel to ground when the golf club 10 is positioned in the golf ball address position. The plies 50 are typically identified, at least in part, by the size and polarity of the angle defined by the fibers 56 or fiber bundles 52 with respect to the composite axis 60. Examples of such descriptions of the plies 50 can be fibers 56 or fiber bundles 52 defining a positive 30 degree angle (such as a ply 50*c* of FIG. 4C), a negative 30 degree angle, a positive 45 degree angle (such as a ply 50*d* of FIG. 4C), a negative 45 degree angle, a positive 60 degree angle, a negative 60 degree angle, a positive 70 degree angle, a negative 70 degree angle, a positive 80 degree angle, a negative 80 degree angle, a 90 degree angle (such as a ply 50*e* of FIG. 4C) extending perpendicular to the axis 60), and a 0 degree angle (such as a ply 50*f* of FIG. 4C) extending parallel to the axis 60). Other positive or negative angles can also be used. The plies 50*a*, 50*b*, 50*c*, 50*d*, 50*e* and 50*f* are also referred to as the ply 50 or the plies 50.

Fiber composite material used to form at least a portion of the faceplate 22 typically includes numerous plies 50. In some implementations, the faceplate 22 formed entirely of fiber composite material. The number of plies 50 used to form a faceplate 22 can be within the range of 3 to 60. In some implementations, the number of plies 50 used to form the faceplate 22, or a portion thereof, is at least 8 plies. In an alternative implementation, the number of plies 50 used to form the faceplate 22, or a portion thereof, is at least 18 plies.

Referring to FIGS. 4A, 4B and 4C, fiber composite materials typically are formed or laid-up using pairs of plies 50 having fiber bundles 52 extending in opposite angular polarities (also referred to as a ply arrangement). For example, a ply 50*a* formed of fiber bundles 52 and fibers 56 generally extending at a positive 60 degree angle (also referred to as a plus 60 degree ply) will be paired with a second ply 50*b* that is formed with fiber bundles 52 and fibers 56 generally extending at a negative 60 degree angle (also referred to as a negative 60 degree ply). This pattern typically extends throughout a fiber composite material. The alternating angular arrangement of the fiber bundles 52 and fibers 56 is important to achieving and maintaining the structural integrity of the component or structure being formed of the fiber composite material. The overlapping of the plies 50 can be essential for ensuring that, once cured, the fiber composite material has the desired strength, durability, toughness and/or reliability. The transition between alternating pairs of plies 50 can also support the structural integrity of the composite structure. For example, a series of six plies could include a pair of plus and minus 60 degree plies, followed by a pair of plus and minus 45 degree plies, followed by another pair of plus and minus 30 degree plies. The transition from the minus 30 degree ply to the adjacent plus 45 degree ply also provides added structural integrity to the fiber composite material because an overlapped region still exists from one ply to an adjacent ply.

The faceplate 22 formed of fiber composite material can include several layers of plus and minus angular plies of different values, such as, for example, plus and minus 30 degree plies, plus and minus 45 degree plies, plus and minus 60 degree plies. One or more layers of 0 degree plies, or 90 degree plies can also be used. In other implementations, two or more of the plies could be positioned with a plus, plus polarity or a negative, negative polarity. Each pair of plies being a separate ply arrangement.

In some implementations, the plies 50 may be separated at least partially by one or more release layers 64 (FIG. 4C). When used, the release layers 64 or veils will generally separate two adjacent plies and inhibit resin flow between adjacent plies during curing. The release layers 64 can also be used to reduce shear stress between layers of the composite material. The release layer 64 can be formed of mylar, polyethylene, glass, nylon or other low surface energy plastic materials. In one implementation, the release layer 64 can have a thickness within the range of 0.001 to 0.005 inch. In other implementations, the release layer can be formed of a thermoplastic material, such as, for example, a thermoplastic urethane or natural rubber. When a thermoplastic material is used as a release layer, the surface of the thermoplastic material can be treated to enhance its bonding to a thermoset resin. The thermoplastic release layer can have a thickness within the range of 0.010 to 0.040 inch. In one implementation, the release layer 64 or veil can be used to enable sliding or independent movement between layers of the composite material when the composite material forming the faceplate 22 impacts a golf ball. In other implementations, one or more scrim layers can be positioned at or near the golf ball impact surface 44 for facilitating sanding, coating and/or painting of the faceplate.

In other implementations, such as the example implementation, of FIG. 4B, no release layers or veils are used. In some implementations, one or more braided plies 66 can be incorporated into the lay-up of plies 50. The braided ply 66 is similar to plies 50 except that the fiber bundles 52, typically extending in a positive and negative angles are woven or braided together about the braided ply 66. In some implementations, the braided ply 66 can be employed to contribute to the structural integrity of the faceplate formed of composite material. In other implementations, the braided ply 66 can be utilized primarily to enhance the appearance of the faceplate.

When the desired number of plies 50 are positioned in overlapping manner over the forming structure (without or without one or more braided plies 66), the assembly is placed into a mold where it is cured under heat and/or pressure. In one implementation, the plies 50 are molded using compression molding. While curing, the resin 54 is configured to flow and fully disperse and impregnate the matrix of fiber bundles 52. After curing, the assembly of plies 50 can be removed from the forming structure 62 and/or the mold to produce the faceplate 22. In some implementations, one or more coating layers can be applied to the outer surface of the faceplate 22. In one implementation, a thermoplastic polyurethane film, or other film, can be applied to the outer surface of the faceplate 22 to enhance the ability of the faceplate 22 to impart spin to the golf ball.

The composite material resulting from the plies 50 and the resin 54 includes certain characteristics such as pre-preg area weight ("PPAW"), fiber area weight ("FAW") and resin content. The PPAW is the weight of the fibers and resin per meter squared. The PPAW of a ply 50 or of a ply arrangement is preferably within the range of 50 to 500 grams/$m^2$. The FAW is a measure of the weight of the fibers per meter squared within a ply 50 or within a ply arrangement. The FAW of a ply 50 or of a ply arrangement is preferably within the range of 70 to 240 grams/$m^2$. Resin content is a measure of the amount of resin used per square meter of fiber composite material.

Through extensive testing of experimental composite layup structures, the inventors have identified that certain features of a composite layup structure provide enhanced performance and durability characteristics to the faceplate. It has been identified that an increased resin content in the resin of the composite material of the faceplate 22 provides desired excellent performance, feel, sound and durability characteristics. In one implementation, the fiber composite material of the faceplate 22 includes the resin, and wherein the quantity of the resin within the fiber composite material of the faceplate 22 is at least 30 percent by weight resin. In another implementation, the quantity of the resin within the fiber composite material of the faceplate 22 is at least 33 percent by weight resin. In another implementations, the quantity of the resin within the fiber composite material of the faceplate 22 is 35 percent by weight resin.

Additionally, the inventors determined that by placing plies 50 formed of glass fibers closer to the golf ball contact surface 44 of the faceplate and placing plies 50 formed of carbon closer to the rear surface 46 of the faceplate 22, the faceplate 22 exhibits exceptional performance, feel and durability. The fiber composite material forming the faceplate 22 includes at least first and second sets of ply arrangements. Each of the ply arrangements includes a pair of plies 50 with one ply 50 having a first plurality of fiber bundles 52 or fibers 56 defining a first angle with respect to the composite axis 60, and the other ply 50 having a second plurality of fibers defining a second angle with respect to the composite axis 60. In one implementation, the first and second angles are plus or minus 45 degrees. In another implementation, the first and second angles are plus or minus 60 degrees. In one implementation, the first and second pluralities of fibers of the first set of ply arrangements are glass fibers 56, and the first and second pluralities of fibers 56 of the second set of ply arrangements are carbon fibers 56. Importantly, the first set of ply arrangements including glass fibers is positioned closer to the golf ball contact surface 44 than to the rear surface 46, and the second set of ply arrangements including carbon fibers is positioned closer the rear surface 46 than to the golf ball contact surface 44.

In one implementation, the ratio of the number of ply arrangements of the first set of ply arrangements of the glass fibers to the number of ply arrangements of the second set of ply arrangements of the carbon fibers is at least 0.25. In another implementation, the ratio of the number of ply arrangements of the first set of ply arrangements to the number of ply arrangements of the second set of ply arrangements is at least 0.30. In another implementation, the ratio of the number of ply arrangements of the first set of ply arrangements to the number of ply arrangements of the second set of ply arrangements is at least 0.35. In another implementation, the ratio of the number of ply arrangements of the first set of ply arrangements to the number of ply arrangements of the second set of ply arrangements is at least 0.40. In still another implementation, the ratio of the number of ply arrangements of the first set of ply arrangements to the number of ply arrangements of the second set of ply arrangements is at least 0.45. In other implementations, a majority of the first and second pluralities of fibers of the ply arrangements between the mid-plane (or the mid-zone) and the golf ball contact surface are formed of glass fibers, and a majority of the first and second pluralities of fibers of the ply arrangements between the mid-plane (or the mid-zone) and the rear surface are formed of carbon fibers. In such implementations, when impacting a golf ball, one or more of the plies 50 of the faceplate 22 in the first set of ply arrangements can be placed in compression, and one or more of the plies 50 in the second set of ply arrangements can be placed in tension. In other implementations, the composite material of the faceplate 22 can include one third of the plies 50 being formed with carbon plies and two-thirds of the plies being formed with glass fibers. In other implementations, the glass fibers can be S-glass fibers, or some of the glass fibers can be S-glass fibers. In other implementations, basalt fibers can be used in place of some or all of the glass fibers.

In other implementations, the number of ply arrangements in the first set of ply arrangements is at least 2, and the number of ply arrangements in the second set of ply arrangements is at least 3. In other implementations, the number of ply arrangements in the first set of ply arrangements is at least 3, and the number of ply arrangements in the second set of ply arrangements is at least 6. In still other implementations, the number of ply arrangements in the first set of ply arrangements is at least 4, and the number of ply arrangements in the second set of ply arrangements is at least 8.

In many implementations, the faceplate 22 is formed of fiber composite material and is quasi-isotropic. The quasi-isotropic characteristic of the composite material forming the faceplate 22 can be accomplished by combining a combination of two or more of the following plies 50: 0 degrees, 90 degrees, plus 45 degrees, minus 45 degrees, plus 60 degrees, and minus 60 degrees. In some implementations, the composite material forming the faceplate 22 is balanced and quasi-isotropic. The resin 46 formed of the thermoset, highly toughened resin drives the performance of the faceplate 22 and the fibers within the composite material keep the faceplate 22 intact.

In one implementation, the faceplate 22 can have a thickness within the range of 0.1 to 0.175 inch. In other implementations, the faceplate 22 can have a thickness within the range of 0.130 to 0.165 inch. In other implementations, the faceplate 22 can have a thickness of approximately 0.16 inch. In other implementations, the faceplate can have a thickness of approximately 0.135 inch. In one example implementation, the faceplate 22 can be formed of 12 ply arrangements of carbon fibers at 60 degrees, then 6 ply arrangements of glass fibers at 60 degrees and an outer layer of carbon weave. In another example implementation, the faceplate 22 can be formed of 12 ply arrangements of carbon fibers at 60 degrees, then 6 ply arrangements of glass fibers at 30 degrees. In another example implementation, the faceplate 22 can be formed of 1 ply arrangement of carbon fibers at 45 degrees, then 8 ply arrangements of carbon fibers at 60 degrees, then 4 ply arrangements of glass fibers at 60 degrees, and an outer layer of carbon weave. In other implementations, the carbon weave can be removed. In other implementations, other fiber angles can be used, and other quantities of ply arrangements can be used.

Figure 5:
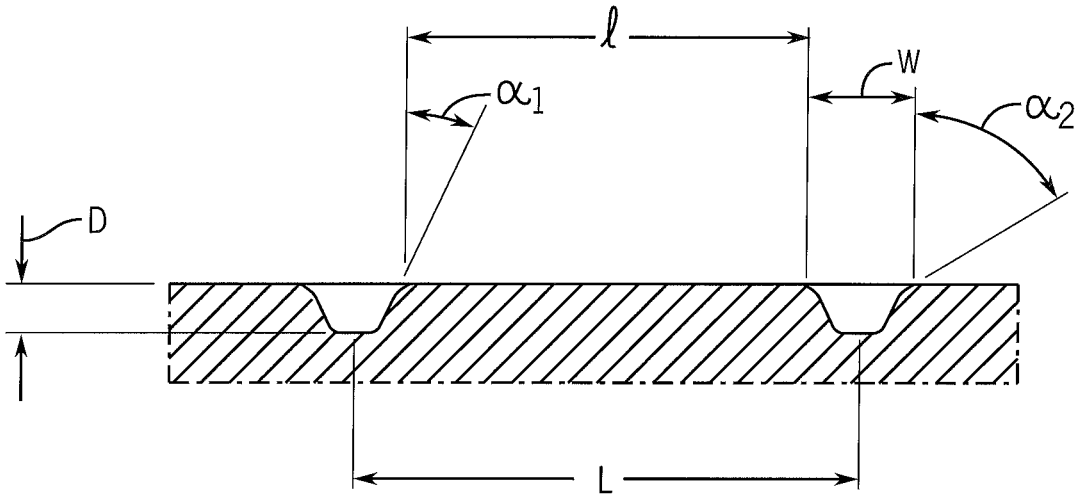
FIG. 5 is an enlarged sectional view of a portion of the faceplate of FIG. 3B.
Figure 6:
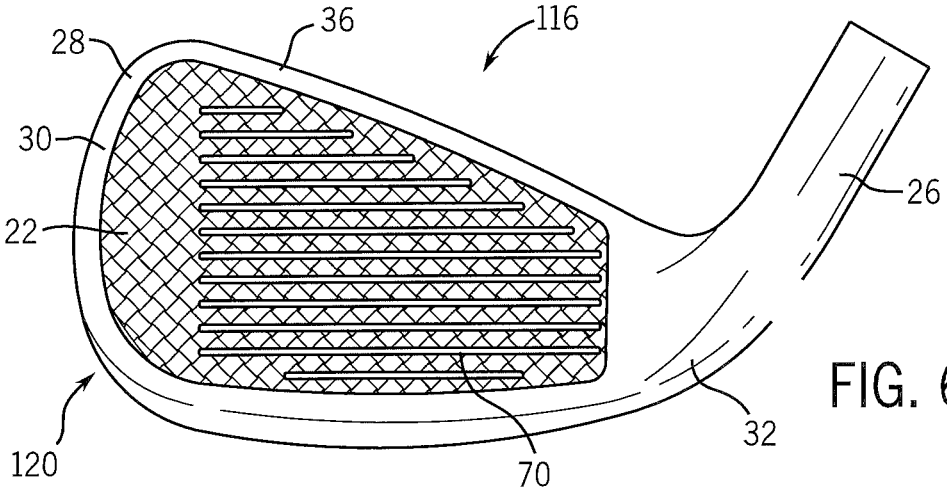
FIG. 6 is a front perspective of the golf club head in accordance with another example implementation of the present invention.
Figure 7:
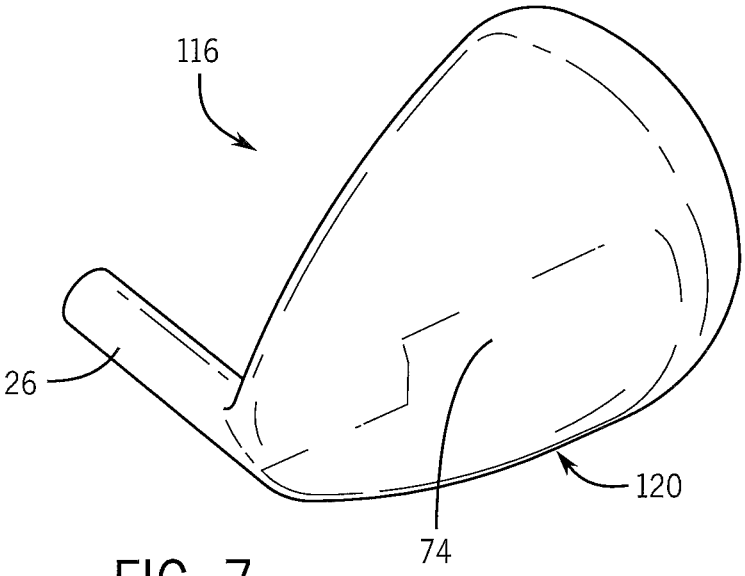
FIG. 7 is a rear, toe end perspective view of the golf club head of FIG. 6.
Figure 8:
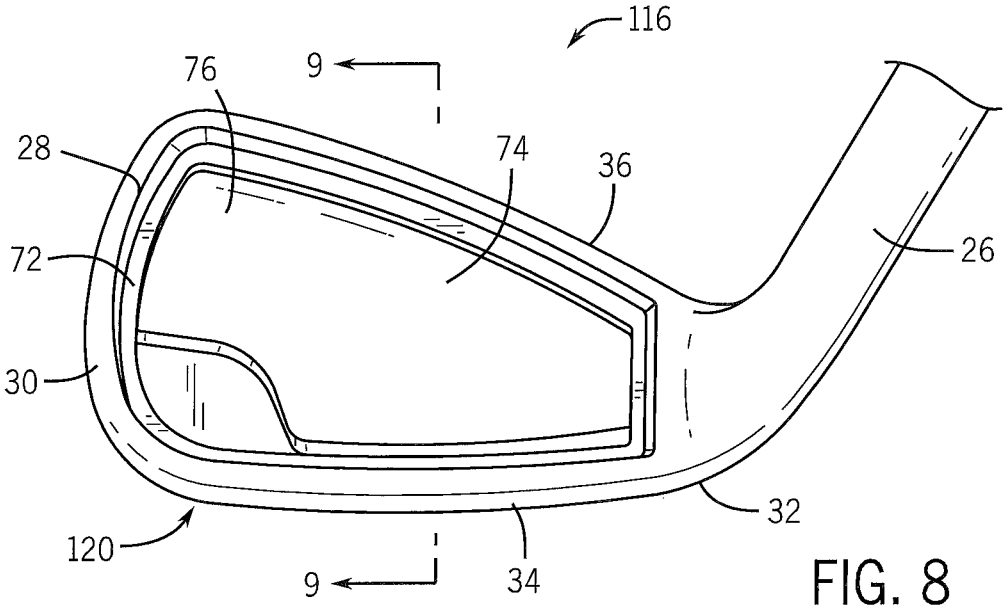
FIG. 8 is a front perspective view of the golf club head of FIG. 6 shown without a faceplate.

FIG. 5 illustrates an example of a set of scorelines 70 that can be formed into the golf ball contact surface 44 of the faceplate 22. In one implementation, the scorelines can be formed during molding of the faceplate 22. In other implementations, the scorelines can be machined into the cured faceplate 22. The scorelines 70 are configured to conform to USGA regulations. In one implementation, the scorelines 70 can have a depth D of no greater than 0.020 inch. In another implementation, the scorelines 70 have a depth D of 0.015+/−0.002 inch. The center to center distance L between the scorelines 70 formed into the faceplate 22 can be within the range of 0.1 to 0.2 inch. In one implementation, the distance L can approximately 0.144 inch. The edge to edge distance/of the scorelines formed into the faceplate 22 can be within the range of 0.09 to 0.018 inch. In one implementation, the distance 1 can be approximately 0.114 inch. The sides of the scorelines 70 can be formed at an angle $\alpha$ or formed from a combination of angles and radius R cuts such that the width of the scoreline 70 narrows as it extends into the faceplate 22. Examples of angles $\alpha_1$ and $\alpha_2$ or combinations of angles $\alpha$ and radiuses used to form the sidewalls of the scorelines 70 can be within the range of 30 degrees to 130 degrees with respect to a plane extending perpendicular from the faceplate 22. Radiuses R can be within the range of 0.003 to 0.020. In some implementations, the angles or combinations of angles and radiuses used to form the sidewalls of the scorelines 70 can be within the range of 50 degrees to 120 degrees with respect to a plane extending perpendicular from the faceplate 22. The maximum width w of the scorelines 70 can be within the range of 0.02 to 0.04 inch. In other implementations, other dimensions, angles and radiuses can be used to form the scorelines. In other implementations, the faceplate 22 can be formed without scorelines.

Referring to FIGS. 3A and 3B, the faceplate supporting wall 28 of the body 20 can be formed with a shoulder 72 for receiving the faceplate 22. In one implementations, the faceplate 22 is bonded to the body 22 using a high performance, highly durable adhesive, such as a two-part epoxy adhesive, to form a high strength bond. In other implementations, the faceplate can be secured to the body through fasteners, molding or other techniques.

Figure 9:
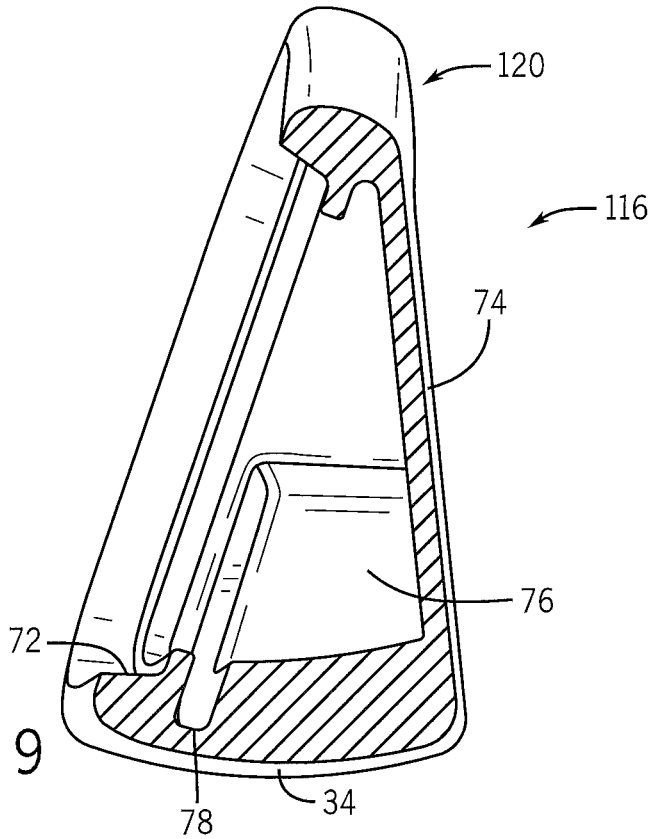
FIG. 9 is a cross-sectional view of the golf club head taken along line 9-9 of FIG. 8.
Figure 10:
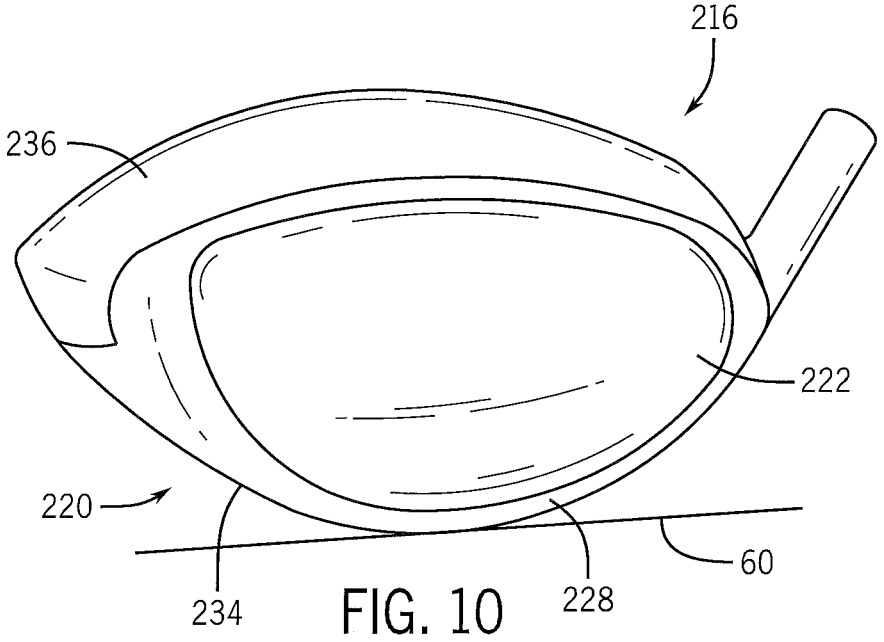
FIG. 10 is a front perspective view of the golf club head in accordance with another example implementation of the present invention.
Figure 11:
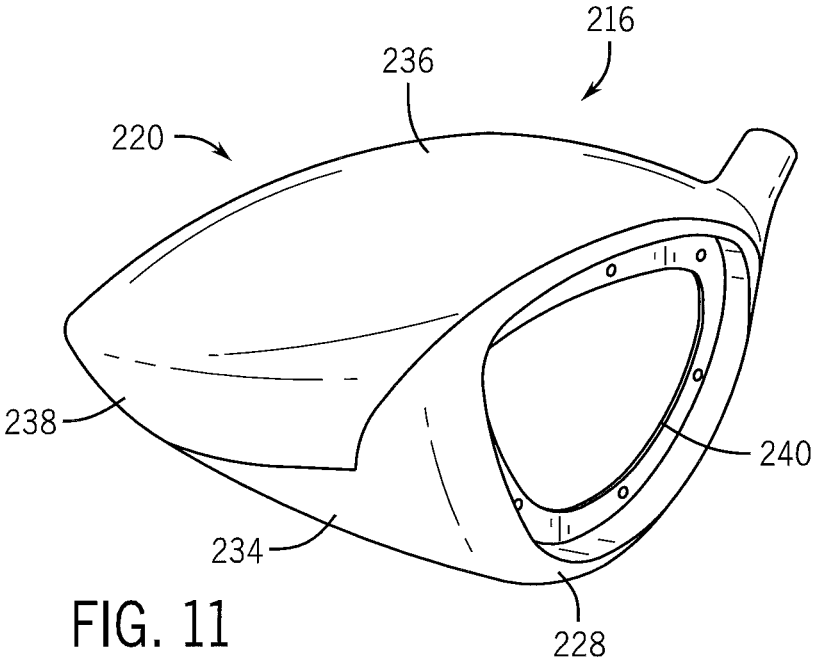
FIG. 11 is a top, toe end perspective view of the golf club head of FIG. 10 shown without a faceplate.
Figure 12:
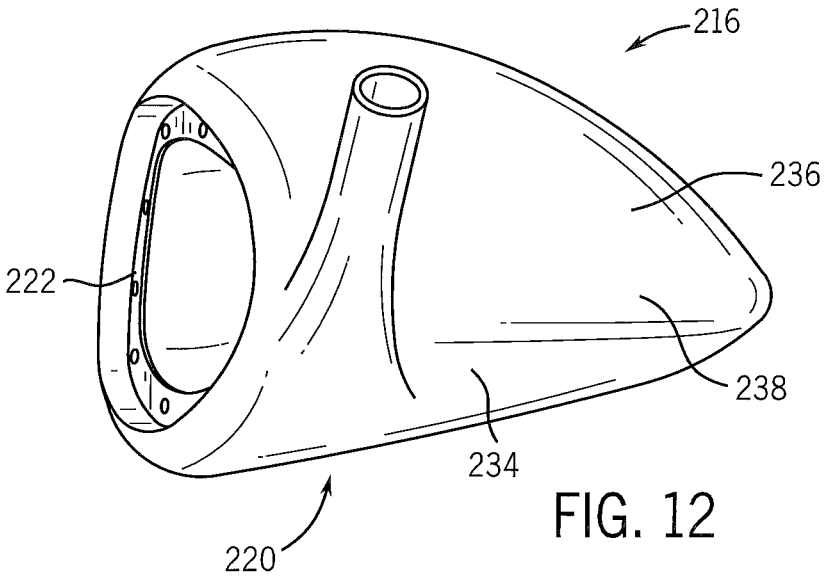
FIG. 12 is a heel end perspective view of the golf club head of FIG. 10.
Figure 13:
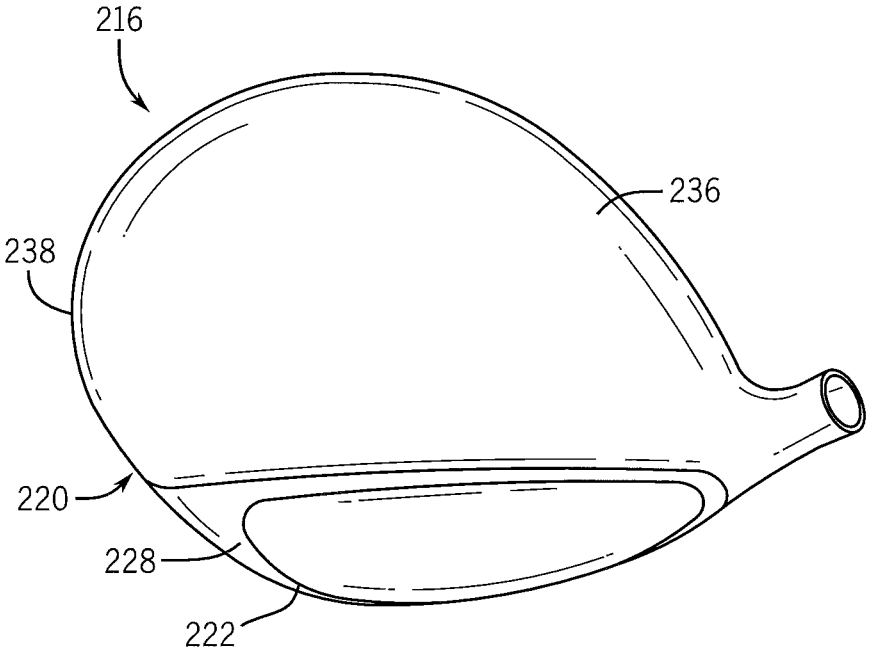
FIG. 13 is a top, front perspective view of the golf club head of FIG. 10.

FIGS. 6 through 9 illustrate the faceplate 22 incorporated into a utility iron golf club head 116. The utility iron golf club head 116 is substantially similar to the iron golf club head 16 except that the utility iron golf club head 116 includes a body 120 having a back wall 74 that defines an enclosed cavity 76 with the faceplate 22, the faceplate supporting wall 28, the toe portion 30, the heel portion 32, the sole 34 and the topline 36. As shown in FIG. 9, the sole 34 of the club head 116 may include a recess 78 for facilitating the responsiveness and performance of the golf club head 116 upon impact with a golf ball.

Golf club heads 16 and 116 constructed with one of the faceplate 22 implementations provide exceptional performance, feel, durability and sound. Table 1 below lists performance characteristics of four prototype utility iron golf club heads that incorporate faceplates 22 of varying thicknesses. An existing Wilson® Staff® Model 18 degree utility iron was used as a control club. The prototypes were tested in player tests.

TABLE 1

| Club Head | Club Speed (mph) | Ball Speed (mph) | Launch Angle (degrees) | Spin Rate (rpm) | Carry Distance (yards) | Total Distance (yards) |
|---|---|---|---|---|---|---|
| Staff ® Model 18 degree | 98.2 | 139.3 | 13.1 | 3517 | 217.2 | 234.8 |
| Proto 17, 18 degrees utility (.155" face) | 98.8 | 138.0 | 12.6 | 4916 | 203.8 | 217.6 |
| Proto 20, 18 degrees utility (.142" face) | 99.2 | 138.8 | 11.6 | 4215 | 209.6 | 226.5 |
| Proto 23, 18 degrees utility (.130" face) | 97.9 | 139.7 | 12.2 | 4193 | 211.5 | 227.3 |
| Proto 4, 26 degrees utility (.119" face) | 99.3 | 139.7 | 12.6 | 4042 | 212.3 | 229.6 |

The test data shown in Table 1 demonstrates the performance advantages that can be achieved with different prototype utility iron club heads configured with implementations of the faceplate 22 of varying face thicknesses. The prototype club heads provide excellent ball speed and distance values while providing exceptional ball spin values. The data of Table 1 also demonstrates how a faceplate can be selected to optimize desired spin rate performance.

Table 2 illustrates characteristic time (CT) test results for 12 prototype faceplates 22 formed of four different faceplate thicknesses. Prototype numbers 17, 20, 23 and 26 are the same prototypes represented in Table 1.

TABLE 2

| Prototype Club Head No. | CT Value | Face Thickness (inch) |
|---|---|---|
| 15 | 209 | 0.155 |
| 16 | 210 | |
| 17 | 209 | |
| 18 | 223 | 0.142 |
| 19 | 223 | |
| 20 | 228 | |
| 21 | 237 | 0.130 |
| 22 | 234 | |
| 23 | 240 | |
| 24 | 264 | 0.119 |
| 25 | 268 | |
| 26 | 266 | |

The CT test results of Table 2 demonstrate that the faceplates 22 produced under the present invention, can be configured to provide a large variety of performance values. The CT test results demonstrate that the faceplates 22 of the present invention can be customized and/or designed to target a specific desired performance level for a particular application. The implementations of the faceplates 22 of the present invention provide an exceptional amount of design and performance flexibility.

Table 3 demonstrates club head performance data from prototype club heads with faceplates 22 from implementations of the present invention along with performance data of a control club head, the Wilson® Staff® Model club head. Golf balls were impacted using the golf club heads of Table 3 using a GolfLabs robot at the swing speeds listed below.

TABLE 3

| | Club Head Speed (mph) | Ball Speed (mph) | Launch Angle | Spin Rate (rpm) | Carry (yards) |
|---|---|---|---|---|---|
| Staff ® Model 18 degree | 95.2 | 138.0 | 13.2 | 4361.3 | 212.9 |
| Prototype 1 (Faceplate thickness 0.155 in) | 95.7 | 136.6 | 12.7 | 4887.6 | 205.5 |
| | 95.7 | 131.5 | 13.2 | 4946.4 | 195.9 |
| | 95.7 | 134.5 | 11.4 | 4897.4 | 200.9 |

TABLE 3-continued

| | Club Head Speed (mph) | Ball Speed (mph) | Launch Angle | Spin Rate (rpm) | Carry (yards) |
|---|---|---|---|---|---|
| Prototype 2 | 95.4 | 136.6 | 12.5 | 4629.1 | 207.3 |
| (Faceplate | 95.8 | 130.4 | 13.2 | 4653.1 | 196.0 |
| thickness | 95.5 | 134.9 | 11.3 | 4686.1 | 202.7 |
| 0.142 in) | | | | | |
| Prototype 3 | 95.7 | 137.5 | 13.2 | 4611.9 | 209.7 |
| (Faceplate | 95.8 | 128.6 | 14.4 | 4439.7 | 194.8 |
| thickness | 95.7 | 135.5 | 11.5 | 4521.0 | 205.6 |
| 0.119 in) | | | | | |

The test results of Table 3 indicate that golf club heads having faceplates 22 built in accordance with implementations of the present invention provide similar launch angle and carry distances when impacted by a golf club under similar swing speeds. Importantly, the prototype faceplates 22 when impacted by the golf club via a GolfLabs robot resulted in significantly higher ball spin rates than the control club head. Accordingly, Tables 1, 2 and 3 illustrate that golf club heads incorporating faceplates 22 from implementations of the present invention provide exceptional performance characteristics including spin rate, exit velocity, launch angle and distance. Additionally, the faceplates 22 can be specifically design to meet desired performance characteristics to satisfy a particular golfer's needs or a specific application.

FIGS. 10 through 13 illustrate a wood-type golf club head 216 include a faceplate 222 formed of fiber composite material. The wood-type golf club head 216 includes a body 220 including a crown 236, a sole 234 and a faceplate receiving region 228. The crown 236 and the sole 234 can form a ribbon or peripheral wall 238 about the periphery of the body 220 rearward of the faceplate receiving region. The body 220 and the faceplate 222 define a wood cavity 240. The faceplate 222 is substantially similar to the faceplate 22 of the previously described implementations, except that faceplate 222 is designed, sized and shaped to fit a wood-type golf club head 216, such as a driver. Although FIGS. 10 through 13 illustrate a driver having the faceplate 222, it is understood that similar faceplates could be used on other wood-type golf club heads or hybrid-style golf club heads. The faceplate 222 includes a slight curvature, and can be formed without scorelines.

Figure 14:
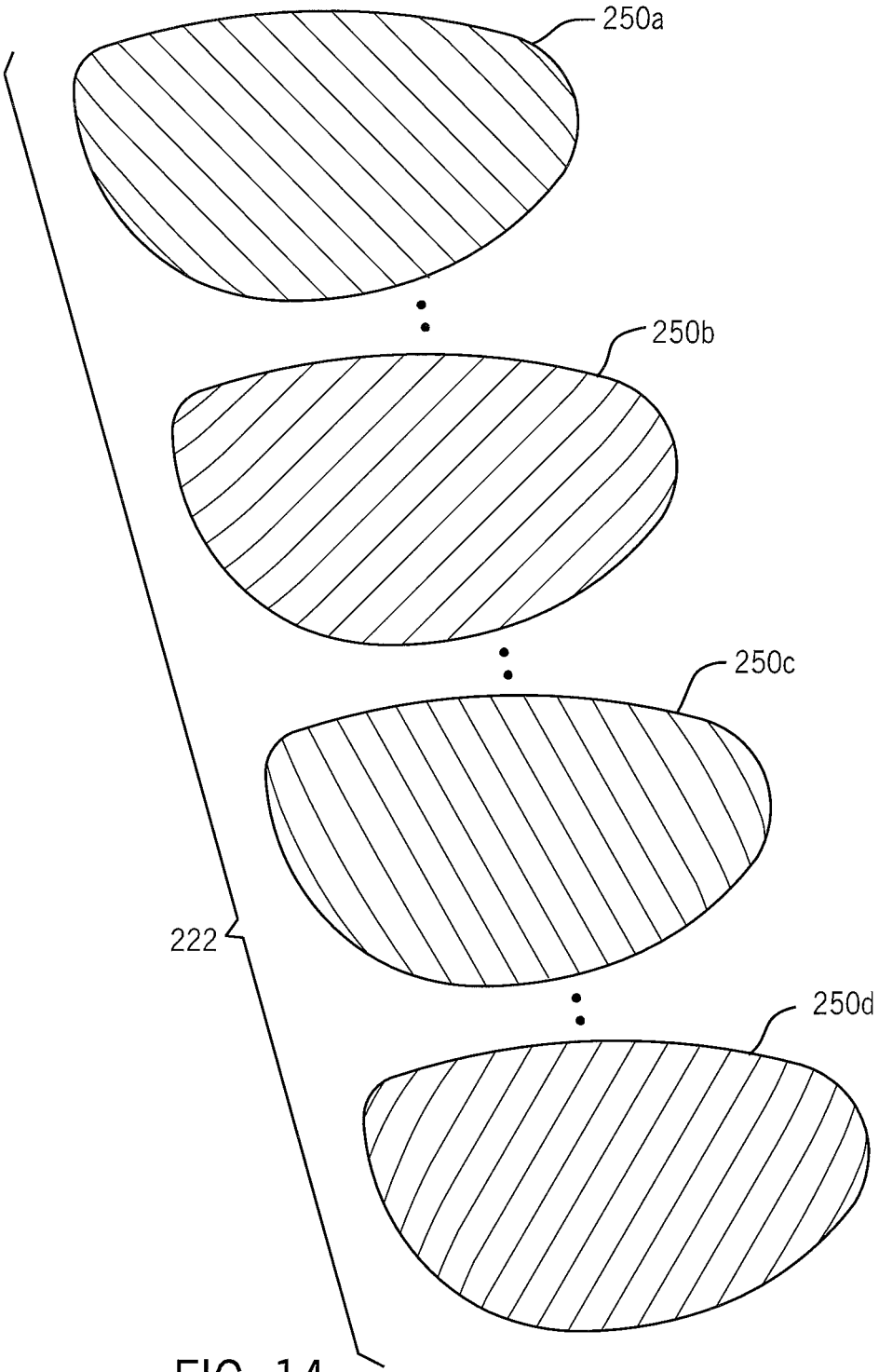
FIG. 14 is a front, side view of a plurality of plies shown in a spaced-apart manner prior to molding.

The faceplate 222 includes plies 50 and ply arrangements as discussed above with respect to faceplate 22. The number of plies, their orientation, the size, the shape, and the curvature can be varied to optimize the performance of the faceplate 222 for a wood-type golf club head 216. Referring to FIG. 14, the faceplate 222, like faceplate 22, is formed form a plurality of plies 250 (also shown as example plies 250*a*, 250*b*, 250*c* and 250*d*). The plies 250 are substantially same as plies 50 in the above-described implementations. FIG. 14 illustrates the four plies 250*a*, 250*b*, 250*c* and 250*d* having varying fiber angles and polarities with respect to the composite axis 60. The faceplate 222 is bonded to the faceplate supporting the body 220 with an epoxy adhesive. In other implementations, the faceplate 222 can be coupled to the body 220 through other conventional fastening mechanisms, such as, for example, other adhesives, urethane adhesives, acrylic adhesives, methacrylate-based adhesives, molding and combinations thereof.

In the same manner as the plies 50, the plies 250 are originally formed in flexible sheets or layers in an uncured resin 54. In this configuration, the fibers 56 and the fiber bundles 52 are arranged and aligned such that the fibers 56 generally extend coaxially with respect to each other and are generally parallel to one another. As the ply 250 (for example, ply 50*a* of FIG. 4A) is positioned over a forming structure 62 or mold, the ply 50 is shaped to follow the form or follow the shape of the forming structure 62. One ply 50 is positioned over another ply 50 and so on. Accordingly, the fiber bundles 52 and fibers 56 also follow the shape of the forming structure. The ply 250 may be formed with some amount of curvature or contour, in which the plies 250 will take a shape that follows the curved shape of the forming structure. The fiber bundles 52 and fibers 56 of the curved plies 250 extend adjacent to one another, and are curved or otherwise formed so that they follow substantially the same adjacent paths. For example, if a ply 250 is wrapped about the convex shaped forming structure, the ply 250 can take a generally convex shape and the fiber bundles 52 and fibers 56 can follow the same convex shape (depending upon their angle within the ply 250). The fiber bundles 52 remain adjacent to one another, are aligned with each other and follow substantially similar paths that are essentially parallel (or even co-axial) for example, when viewed in a sectional view in a single plane or other small finite segment of the ply 250.

The present invention provides numerous advantages over existing golf clubs. The present invention provides a golf club head with a composite faceplate that provide exceptional performance, feel and sound. The implementations of the present invention allow for increased design flexibility in designing and developing a golf club faceplate that meets a player's needs. Further, the present invention provides a golf club that meets these needs while also providing an improved, pleasing aesthetic. The golf club head with a composite faceplate is also configured for use in competitive play including tournament play by satisfying the requirements of The Rules of Golf as approved by the U.S. Golf Association and the Royal and Ancient Golf Club of St. Andrews, Scotland effective Jan. 1, 2019 ("The Rules of Golf"). Accordingly, the term "golf club is configured for organized, competitive play" refers to a golf club with a composite faceplate that fully meets the golf shaft rules and/or requirements of The Rules of Golf.

Although the present disclosure has been described with reference to example implementations, workers skilled in the art will recognize that changes may be made in form and detail without departing from the spirit and scope of the claimed subject matter. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure. Accordingly, it will be intended to include all such alternatives, modifications and variations set forth within the spirit and scope of the appended claims. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A golf club configured to be positioned in a golf ball address position, the golf club comprising:

a body having a heel portion and a toe portion, a composite axis extending from the heel portion to the toe portion and being parallel to ground when the golf club is positioned in the golf ball address position; and a face coupled to the body, the face having a golf ball contact surface and an rear surface, the face formed of a fiber composite material, the fiber composite material including at least first and second sets of ply arrangements, the first set of ply arrangements having a first number of ply arrangements and the second set of ply arrangements having a number of ply arrangements, each of the ply arrangements including a pair of consecutive plies with one ply having a first plurality of fibers defining a first angle with respect to the composite axis and the other ply having a second plurality of fibers defining a second angle with respect to the composite axis, wherein a majority of the first plurality of fibers are oriented to extend coaxially and parallel to one another at the first angle and wherein a majority of the second plurality of fibers are oriented to extend coaxially in parallel to one another at the second angle, the pair of plies including at least one resin, the first and second pluralities of fibers of the first set of ply arrangements being glass fibers and the first and second pluralities of fibers of the second set of ply arrangements being carbon fibers, the first set of ply arrangements being positioned closer to the golf ball contact surface than to the rear surface, and the second set of ply arrangements being positioned closer the rear surface than to the golf ball contact surface, the ratio of the first number of ply arrangements of the first set of ply arrangements to the second number of ply arrangements of the second set of ply arrangements being at least 0.25; and at least one release layer, wherein the first and second sets of ply arrangements comprise a series of adjacent plies forming the pair of consecutive plies of each of the ply arrangements, wherein the golf club is a finished golf club and wherein the at least one release layer comprises a particular release layer separating the two adjacent plies of the series of adjacent plies.

2. The golf club of claim 1, wherein the first and second angles are substantially the same except the first and second angles have opposite angular polarities with respect to the composite axis.

3. The golf club of claim 1, wherein the ratio of the number of ply arrangements of the first set of ply arrangements to the number of ply arrangements of the second set of ply arrangements is at least 0.30.

4. The golf club of claim 1, wherein the ratio of the number of ply arrangements of the first set of ply arrangements to the number of ply arrangements of the second set of ply arrangements is at least 0.35.

5. The golf club of claim 1, wherein the ratio of the number of ply arrangements of the first set of ply arrangements to the number of ply arrangements of the second set of ply arrangements is at least 0.40.

6. The golf club of claim 1, wherein the ratio of the number of ply arrangements of the first set of ply arrangements to the number of ply arrangements of the second set of ply arrangements is at least 0.45.

7. The golf club of claim 1, wherein the number of ply arrangements in the first set of ply arrangements is at least 2, and the number of ply arrangements in the second set of ply arrangements is at least 3.

8. The golf club of claim 1, wherein the number of ply arrangements in the first set of ply arrangements is at least 3, and the number of ply arrangements in the second set of ply arrangements is at least 6.

9. The golf club of claim 1, wherein the number of ply arrangements in the first set of ply arrangements is at least 4, and the number of ply arrangements in the second set of ply arrangements is at least 8.

10. The golf club of claim 1, wherein the first and second angles are at least 45 degrees.

11. The golf club of claim 1, wherein the first and second angles are approximately 60 degrees.

12. The golf club of claim 1, wherein the quantity of resin within the fiber composite material of the face is at least 30 percent by weight resin.

13. The golf club of claim 1, wherein the quantity of resin within the fiber composite material of the face is at least 33 percent by weight resin.

14. The golf club of claim 1, wherein the resin is a thermoset material.

15. The golf club of claim 1, wherein the golf club is an iron golf club.

16. The golf club of claim 1, wherein the golf club is a wood style golf club.

17. The golf club of claim 1, wherein the golf club is a hybrid golf club.

18. The golf club of claim 1, wherein the face further comprises at least one braided fiber composite layer positioned at or near the golf ball contact surface of the face.

* * * * *